US007591460B2

(12) United States Patent
Ohshima et al.

(10) Patent No.: US 7,591,460 B2
(45) Date of Patent: Sep. 22, 2009

(54) SHEET FEEDING APPARATUS, IMAGE FORMING APPARATUS AND SHEET FEEDING METHOD

(75) Inventors: Minoru Ohshima, Kanagawa (JP); Kaoru Yoshida, Kanagawa (JP); Yoshinari Iwaki, Kanagawa (JP); Takao Furuya, Kanagawa (JP); Shin Takeuchi, Kanagawa (JP); Ivutin Dmitry, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/000,634

(22) Filed: Dec. 14, 2007

(65) Prior Publication Data

US 2008/0303206 A1 Dec. 11, 2008

(30) Foreign Application Priority Data

Jun. 8, 2007 (JP) ..... 2007-152940

(51) Int. Cl.
*B65H 3/52* (2006.01)
*B65H 7/08* (2006.01)

(52) U.S. Cl. ..... 271/125; 271/110; 271/121; 271/124

(58) Field of Classification Search ..... 271/110, 271/109, 122, 121, 113, 262, 265.04
See application file for complete search history.

(56) References Cited

U.S. PATENT DOCUMENTS 6,913,257 B2 * 7/2005 Takaki et al. ..... 271/125
7,007,945 B2 * 3/2006 Hiramitsu et al. ..... 271/125
7,152,861 B2 * 12/2006 Kawasaki ..... 271/262
7,234,695 B2 * 6/2007 Tsukamoto et al. ..... 271/122
7,270,326 B2 * 9/2007 Mitsuya et al. ..... 271/265.04
7,334,788 B2 * 2/2008 Sakamaki et al. ..... 271/125
7,392,980 B2 * 7/2008 Takeuchi et al. ..... 271/125
2002/0020957 A1 * 2/2002 Araki et al. ..... 271/10.11
2004/0265031 A1 * 12/2004 Ueda ..... 400/636
2005/0184447 A1 * 8/2005 Tsukamoto et al. ..... 271/109
2006/0214356 A1 * 9/2006 Yasukawa et al. ..... 271/10.13
2007/0096385 A1 * 5/2007 Mandel et al. ..... 271/122

(Continued)

FOREIGN PATENT DOCUMENTS

JP 56070247 * 6/1981

(Continued)

*Primary Examiner*—Patrick H Mackey
*Assistant Examiner*—Patrick Cicchino
(74) *Attorney, Agent, or Firm*—Oliff & Berridge, PLC

(57) ABSTRACT

A sheet feeding apparatus includes: a multiple-feed detecting section that detects recording sheets to be transported by plural rolls in a direction; a separating section that separates an uppermost sheet of the recording sheets from the other; a slippage detecting section that detects a slippage of the uppermost recording sheet with respect to a roll; and a transporting-speed reduction suppressing section that suppresses a transporting-speed of the uppermost recording sheet from reducing from a value, the separation section including: a transporting roll that transports recording sheets in a transporting direction; and a separation roll that is placed to be opposed to and to be press-contacted with the transporting roll through a recording sheet, the transporting-speed reduction suppressing section changing a separation torque of the separation roll according based on a result of detection by the multiple-feed detecting section and a result of detection by the slippage detecting section.

10 Claims, 10 Drawing Sheets

U.S. PATENT DOCUMENTS

| | | | | |
|---|---|---|---|---|
| 2007/0126171 | A1* | 6/2007 | Takeuchi et al. | |
| 2007/0257418 | A1* | 11/2007 | Tsukamoto et al. | 271/110 |
| 2008/0237969 | A1* | 10/2008 | Totsuka et al. | 271/109 |

FOREIGN PATENT DOCUMENTS

| | | | |
|---|---|---|---|
| JP | 04144847 | * | 5/1992 |
| JP | A 2001-106372 | | 4/2001 |
| JP | A 2005-350239 | | 12/2005 |

* cited by examiner

FIG. 4B

| | VALUES OF SEPARATION TORQUE [mNm] | |
|---|---|---|
| THE NUMBER OF SHEETS DETECTED BY SENSOR | Vf (OR Vt) > V0 | Vf (OR Vt) ≒ V0 |
| 0 OR 1 | T1a | T1 |
| ≥ 2 | T2a | T2 |

FIG. 5B

| | VALUE OF SEPARATION TORQUE [mNm] | | | |
|---|---|---|---|---|
| | POSITION OF LEADING END OF TOP SHEET : ANTERIOR TO DRAWING ROLL | | POSITION OF LEADING END OF TOP SHEET : POSTERIOR TO DRAWING ROLL | |
| THE NUMBER OF SHEETS DETECTED BY SENSOR | Vfr > V0 | Vfr ≒ V0 | Vta > V0 | Vta ≒ V0 |
| 0 OR 1 | T1a, T1b | T1 | T1a | T1 |
| 2 ≤ | T2a, T2b | T2 | T2a | T2 |

FIG. 6B

| | VALUE OF SEPARATION TORQUE [mNm] | | | |
|---|---|---|---|---|
| | POSITION OF LEADING END OF TOP SHEET : ANTERIOR TO DRAWING ROLL | | POSITION OF LEADING END OF TOP SHEET : POSTERIOR TO DRAWING ROLL | |
| THE NUMBER OF SHEETS DETECTED BY SENSOR | Vfr > V0 | Vfr ≒ V0 | Vta > V0 | Vta ≒ V0 |
| 0 OR 1 | T1a, T1b | T1 | T1a | T1 |
| 2 | SECOND SHEET POSITION CONTROL (SEQUENTIAL VARIABLE CONTROL) | | | |
| ≥ 3 | T3a, T3b | T3 | T3a | T3 |

SHEET FEEDING APPARATUS, IMAGE FORMING APPARATUS AND SHEET FEEDING METHOD

CROSS-REFERENCE TO RELATED APPLICATION

This application is based on and claims priority under 35 USC §119 from Japanese Patent Application No. 2007-152940 filed Jun. 8, 2007.

BACKGROUND (i) Technical Field

The present invention relates to a sheet feeding apparatus for separating and supplying recording paper sheets one by one, an image forming apparatus having such a sheet feeding apparatus, and a sheet feeding method.

(ii) Related Art

An image forming apparatus in the background art, such as a copying machine and a printer, is provided with a sheet feeding apparatus which separates recording sheets stacked and accommodated in a sheet feeing portion one by one, so as to stably supply recording sheets, on which an image is formed, to an image forming portion.

SUMMARY

According to an aspect of the invention, there is provided a sheet feeding apparatus comprising:

a multiple-feed detecting section that detects recording sheets superposed with each other to be transported by plural rolls in a direction;

a separating section that, in a case where recording sheets are transported with being superposed with each other, separates an uppermost sheet of the recording sheets from the other;

a slippage detecting section that detects a slippage of the uppermost recording sheet with respect to a roll; and a transporting-speed reduction suppressing section that suppresses a transporting-speed of the uppermost recording sheet from reducing from a value, the separation section including: a transporting roll that transports recording sheets in a transporting direction; and a separation roll that is placed to be opposed to and to be press-contacted with the transporting roll through a recording sheet, the transporting-speed reduction suppressing section changing a separation torque of the separation roll according based on a result of detection by the multiple-feed detecting section and a result of detection by the slippage detecting section.

BRIEF DESCRIPTION OF THE DRAWINGS

Embodiments of the present invention will be described in detail based on the following figures, wherein:

FIG. 4B is a table summarizingly describing a relation between the number of recording sheets and the value of separation torque according to Embodiment 1;

FIG. 5B is a table summarizingly describing the relation between the number of recording sheets and the value of separation torque according to Embodiment 2;

FIG. 6B is a table summarizingly describing a relation between the number of recording sheets and the value of separation torque according to Embodiment 3.

Figure 1:
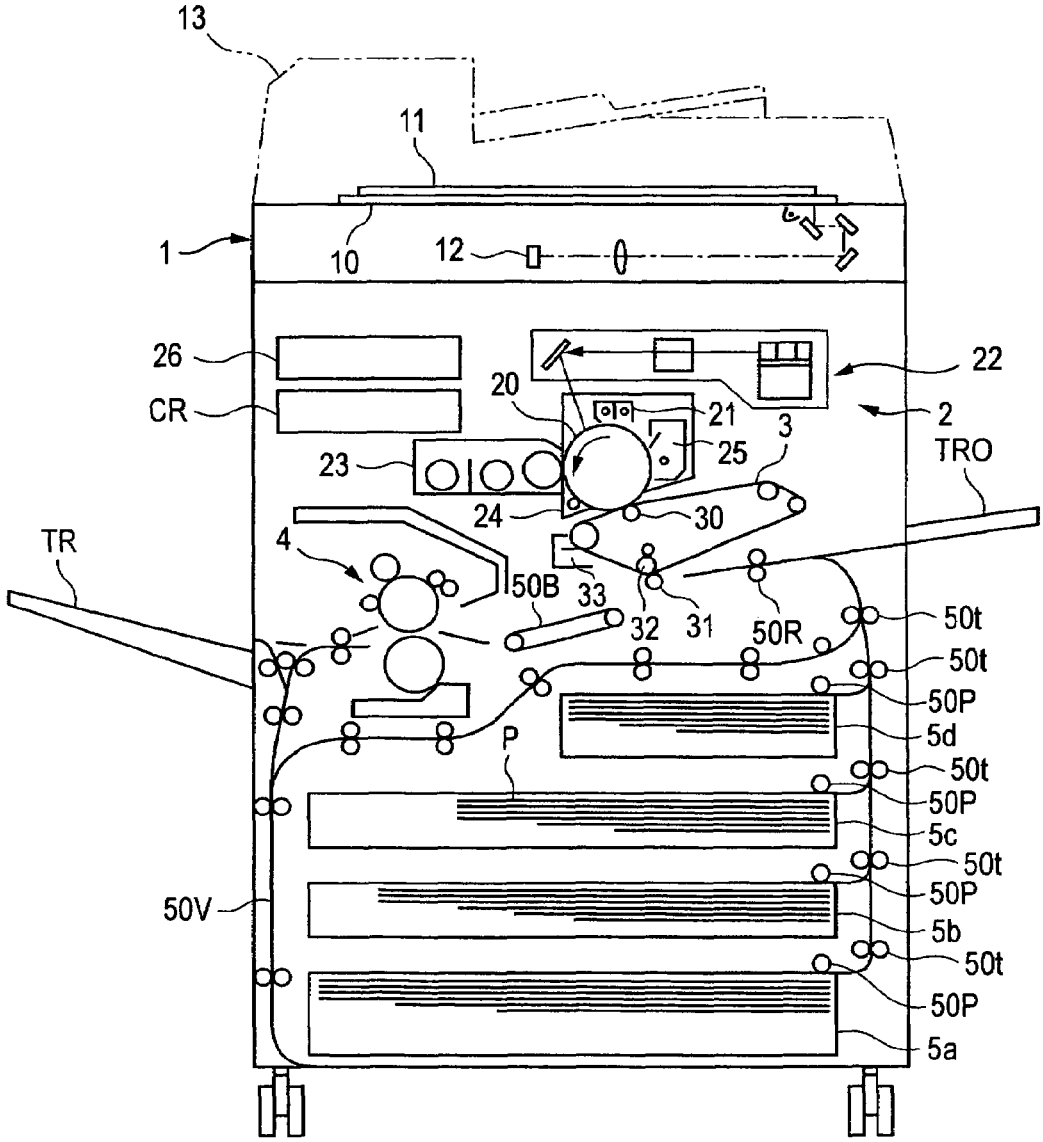
FIG. 1 is a view illustrating a configuration of an image forming apparatus according to an exemplary embodiment of the invention.

3: intermediate transfer belt
4: fixing device
5: sheet feed tray
20: photosensitive drum
21: charging corotron
22: laser beam scanner
25: drum cleaner
30: primary transfer roll
31: secondary transfer roll
32: backup roll
33: belt cleaner
50: sheet feeding apparatus
50B: transporting belt
50N: press-contact portion
50P: sheet feeding roll
50R: registration roll
50T: drawing roll
51: detection roll
52: sheet number detection sensor
53: transporting roll
54: torque sensor
59: arrival detecting section
CR: control unit
L: operating line
Lo: operating point
P: recording paper
R1: misfeed area
R2: multiple-feeding area
TL: load torque
TR: discharge tray
Vf: transporting roll rotation speed
Vt: drawing roll rotation speed

DETAILED DESCRIPTION

Hereinafter, embodiments according to the invention are described below with reference to the accompanying drawings.

First, a configuration of an image forming apparatus according to an exemplary embodiment of the invention is described below with reference to FIG. 1. FIG. 1 illustrates the configuration of the entire image forming apparatus according to an exemplary embodiment of the invention.

As illustrated in FIG. 1, the image forming apparatus according to the invention includes an image input portion (IIT) 1, which optically reads image information of an original 11 placed on a platen 10 and causes a charge-coupled device (CCD) sensor 12 to convert the image information into electrical image data, and includes also an image output portion (IOT) 2 that forms an image on a recording sheet P according to image data transferred from the image input portion 1. Additionally, an automatic document feeder (ADF), which automatically feed the original 11 to the platen 10, can be attached to the image input portion 1.

The image output portion 2 forms a toner image on a photosensitive drum 20 according to image data transferred from the image input portion 1. Subsequently, a primary transfer of such a toner image onto an endless intermediate transfer belt 3 is performed. Then, a secondary transfer of the toner image, which is formed on the intermediate transfer belt 3, onto a recording sheet P is performed. Thus, a recording image is formed on the recording sheet P. Subsequently, the recording sheet P, onto which a toner image is transferred, is discharged onto a discharge tray TR through a fixing device 4.

The photosensitive drum 20 is turned in a direction of an arrow at a predetermined process speed. Around the photosensitive drum 20, the following devices are placed. That is, a charging corotron 21 which uniformly charges a surface of such a photosensitive drum 20 to a predetermined background portion potential level, a laser beam scanner 22 which exposes the photosensitive drum 20 by laser beams modulated according to image data so as to form an electrostatic latent image on the photosensitive drum 20, a development device 23 which develops the electrostatic latent image formed on the photosensitive drum 20, a transfer preprocessing corotron 24 which eliminates the potential from the surface of the photosensitive drum 20 before the primary transfer of a toner image onto the intermediate transfer belt 3, and a drum cleaner 25, which eliminates residual toner on the photosensitive drum 20 upon completion of performing the primary transfer of an toner image, are provided.

On the other hand, the intermediate transfer belt 3 is laid around plural rolls and is turned in the direction of an arrow. A toner image formed on the photosensitive drum 20 is transferred onto the intermediate transfer belt 3. Subsequently, a secondary transfer of the toner image onto a recording sheet P from such an intermediate transfer belt 3 is performed. A primary transfer roll 30, which forms a transfer electric-field extending therefrom to the photosensitive drum 20, is provided to face the photosensitive drum 20 across the intermediate transfer belt 3. Meanwhile, a secondary transfer roll 31 and a backup roll 32 are provided across the intermediate transfer belt 3 at a secondary transfer position at which a secondary transfer of a toner image is performed. The recording sheet P is inserted into between the secondary transfer roll 31 and the intermediate transfer belt 3. A toner image primary-transferred onto the intermediate transfer belt 3 is secondary-transferred onto the recording sheet P. A belt cleaner 33 for cleaning paper powder and residual toner from a surface of the intermediate transfer belt 3 is provided at a part of a turning path of the intermediate transfer belt 3, which is located between a primary transfer position and the secondary transfer position.

A sheet feeding portion for supplying recording sheets P to the image output portion 2 is provided under the image output portion 2. The sheet feeding portion is equipped with four sheet feeding trays 5*a* to 5*d* respectively accommodating different-size recording sheets P. Recording sheets P of a size selected in a copying operation are sent from one of the sheet feeding trays to the image output portion 2 by turning a pickup roll 50P. Plural sheet transporting rolls 50*t* are provided on a transporting path extending from each of the sheet feeding trays 5*a* to 5*d* to the secondary transfer position at which a toner image is transferred onto a recording sheet. Registration rolls 50R are placed just anterior to the secondary transfer position. Such registration rolls 50R feed recording sheets P supplied from the sheet feeding trays 5*a* to 5*d* to the secondary transfer position at predetermined timing synchronized with timing at which an electrostatic latent image is written to the photosensitive drum 20.

Incidentally, in FIG. 1, reference numeral 26 designates an image processing portion for supplying image data to the laser beam scanner 22 after processing image data, which has been transferred from the image input portion 1 to the image output portion 2, according to information representing a copying operation. Reference character 50B denotes a sheet transporting belt for feeding a recording sheet P, onto which a toner image is secondary-transferred, to the fixing device 4. Reference character 50V represents an inverter path for feeding, when double-sided copying of a recording sheet P is performed, the recording sheet P from the fixing device 4 to the secondary transfer position by reversing the recording sheet P. Reference character TR0 designates a manual feed tray used for manual feed of recording sheets P. Reference character CR denotes a device controller for controlling each component device.

In the image forming apparatus constituted as described above, the laser beam scanner 22 exposes the photosensitive drum 20 according to image information of an original, which is input by the image input portion 1. An electrostatic latent image corresponding to the image information is written onto the photosensitive drum 20. This electrostatic latent image is developed by the development device 23 so that developing timing lags a little behind the writing timing at which the electrostatic latent image is written to the drum. Then, a voltage of a polarity opposite to that of charged toner is applied to the base material of the intermediate transfer belt 3 by the primary transfer roll 30 in a primary transfer part in which the photosensitive drum 20 and the intermediate transfer belt 3 are press-contacted with each other. Thus, a toner image formed in this way is primary-transferred onto a surface of the intermediate transfer belt 3 by a press-contact force and an electrostatic attracting force. An unfixed-toner image primary-transferred onto the intermediate transfer belt 3 is transported by the rotation of the intermediate transfer belt 3 to a secondary transfer part that faces a transporting path on which recording sheets P are transported. Residual toner on the photosensitive drum 20, onto which the toner image has been primary-transferred, is scraped off therefrom by an elastic cleaning blade of the drum cleaner 25. Thus, the sheet feeding apparatus is prepared for the next image forming cycle.

In the secondary transfer part, the secondary transfer roll 31 is pressed through the intermediate transfer belt 3 against the backup roll 32 provided in a space surrounded by the intermediate transfer belt 3. A recording sheet P carried out with predetermined timing as a recording medium is inserted into between the secondary transfer roll 31 and the intermediate transfer belt 3 by a registration roll 50R.

Then, unfixed toner images held on the intermediate transfer belt 3 are electrostatically transferred onto a recording sheet P in the secondary transfer part by a transfer electric-field formed between the backup roll 32 and the secondary transfer roll 31.

The recording sheet P, onto which the unfixed toner image is transferred, is fed into the fixing device 4 through the transporting belt 50B. This toner image is fixed onto the recording sheet P by heat and pressure by the fixing device 4. Subsequently, the recording sheet P, to which the toner image is fixed, is discharged to the discharge tray TR. Incidentally, residual toner on which the intermediate transfer belt 3 on which the transfer of the unfixed toner image onto the recording sheet P has been completed, is removed by the belt cleaner 33.

Next, the configuration of a sheet feeding apparatus according to the present embodiment is described below with reference to FIG. 2. Incidentally, FIG. 2 is a schematic view illustrating the general configuration of the sheet feeding apparatus according to the present embodiment and illustrating also an operation of controlling this sheet feeding apparatus.

Figure 2:
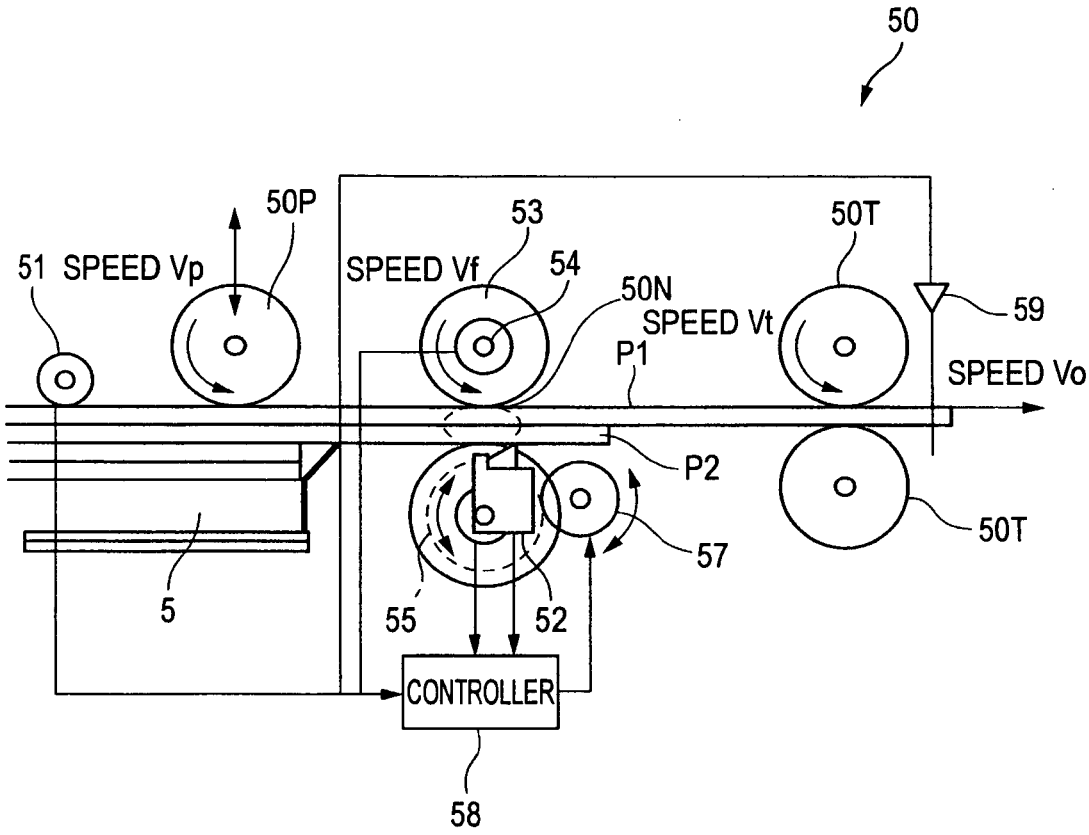
FIG. 2 is a schematic view illustrating a configuration of a sheet feeding apparatus according to an exemplary embodiment of the invention and illustrating also an operation of controlling this sheet feeding apparatus.

As illustrated in FIG. 2, the sheet feeding apparatus 50 according to the present embodiment includes the sheet feeding trays 5*a* to 5*d* (hereunder referred to generically as the sheet feeding tray 5, because the sheet feeding trays 5*a* to 5*d* basically have the same structure) for accommodating plural recording sheets P by stacking the recording sheets P, the sheet feeding rolls 50P for drawing the top (uppermost) recording sheet P1 from the recording sheets P accommodated in the sheet feeding tray 5 and for feeding the top recording sheet P1 to the predetermined transporting path, a pair of the transporting roll 53 and the separation roll 55, which are placed downstream in the transporting direction of the sheet feeding roll 50P to face each other and constitute the separation section, and a pair of drawing-rolls 50T, 50T, which are provided downstream from the separation section and which draw a recording sheet P out of the press-contact portion 50N between the transporting roll 53 and the separation roll 55 and transport the recording sheet P to a transporting roll in a subsequent stage. A detection roll 51, which rotates with transporting the recording sheet P1 and detects a movement speed or an amount of displacement of the top recording sheet P1, is provided in the vicinity of the sheet feeding roll 50P. A sheet number detecting sensor 52 serving as the multiple-feed detecting section for detecting the number of multiply-fed recording sheets P being present in the press-contact portion 50N is provided in the vicinity of the separation roll 55. For example, conventionally known optical type, capacitance type, and mechanical type multiple-feed detecting sensors for determining the number of multiply-fed recording sheets by detecting a total thickness of multiply-fed recording sheets P1, P2, . . . can appropriately be used as the sheet number detecting sensor 52.

The slippage detecting section according to the present embodiment detects the presence/absence of occurrence of slippage between a recording sheet P and a predetermined roll by comparing the rotation speed (or the amount of rotation) of the detecting roll 51 with the associated predetermined rotation speed (or the associated predetermined amount of rotation) of the transporting roll 53 or the drawing roll 50T.

The sheet feeding tray 5 is constituted detachably from a casing of an image forming apparatus. Recording sheets P are accommodated in the sheet feeding tray 5. The sheet feeding tray 5 is provided with a bottom plate (not shown) for lifting up the entire recording sheets P so that the uppermost recording sheet P1 in the sheet feeding tray 5 is placed at a predetermined position.

On the other hand, the aforementioned sheet feeding roll 50P is attached to the casing of the image forming apparatus, into which the sheet feeding tray 5 is inserted. The sheet feeding roll 50P is contactable with the uppermost recording sheet P1 lifted up to the predetermined position and can change the press-contact force that acts upon the recording sheet P1. The sheet feeding roll 50P moves from a separation position to a contact position according to, for example, a transport start instruction issued from a control unit CR to rotate while being press-contacted with the uppermost recording sheet P1. The recording sheet P1 is drawn out of the sheet feeding tray 5 in the predetermined transporting direction (hereunder referred to also as a forward direction) by this press-contact rotation force of the sheet feeding roll 50P. In the case of occurrence of a state (hereunder referred to also as a multiple feed state) in which plural recording sheets P are present in the press-contact portion 50N, the recording sheets P are separated into the uppermost recording sheet P1 and the other recording sheets P2, P3, . . . when the recording sheets P pass through the press-contact portion 50N. Thus, the recording sheets P are transported on the predetermined transporting path one by one.

The transporting roll 53 is constituted to be rotated at a predetermined rotation speed (or amount of rotation) by a drive source (not shown) so as to transport the uppermost recording sheet P1 in the forward direction. A known torque sensor 54 is attached to the rotating shaft of the transporting roll 53 so as to be able to detect load torque when a recording sheet P is transported.

On the other hand, the separation roll 55 is constituted to be contacted with the bottom surfaces of the multiply-fed recording sheets P2, P3 . . . to provide separation torque to the recording sheets P2, P3 . . . so as to backwardly feed the recording sheets in a direction opposite to the predetermined transporting direction. The separation roll 55 is constituted to be drive-controlled by a drive portion 57 and a controller 58, which constitute a feedback control system including a speed sensor, a torque limiter, and a direct-current (DC) motor so as to change the separation torque. More specifically, in the sheet feeding apparatus 50 according to the present embodiment, separation torque to be generated in the separation roll 55 is changed between the separation torque T2 to be generated therein in the case of occurrence of multiple feed (i.e., in a case where two or more recording sheets are present in the press-contact portion 50N), and the separation torque T1 to be generated therein in the case of an ordinary transporting state in which no multiple feed occurs. Also, the separation torque T2 to be generated in the case of occurrence of multiple feed is set to be larger than the separation torque T1 to be generated in the case of an ordinary transporting state. Consequently, the separation performance at occurrence of a multiple-feed can be enhanced. Additionally, the device controller CR can be used also as the controller 58. Apparently, another controller can alternatively be provided as the controller 58.

Further, the drawing roll 50T provided downstream from the press-contact portion 50N is constituted as the pair of opposed rolls 50T, 50T, and is caused by a drive source (not shown) to rotate at a predetermined rotation speed (or a predetermined amount of rotation). According to the present embodiment, the drawing roll 50T is constituted as the pair of opposed rolls 50T, 50T. However, as long as the drawing roll is constituted to be able to draw a recording sheet out of the press-contact portion 50N of the separation section, any other drawing section can be employed. For example, the drawing roll 50T can be press-contacted with the predetermined transporting path.

A known optical type sensor can additionally be provided as an arrival detecting section 59. However, according to the present embodiment, the arrival detecting section is constituted by calculating a movement distance of a recording sheet P according to an amount of rotation of the detection roll 51. That is, the detection roll 51 is used as both of the arrival detecting section 59 and a part of the aforementioned slippage detecting section. Consequently, the miniaturization and the cost reduction of a sheet feeding apparatus can be achieved by reducing the number of sensors.

Also, the transporting speed reduction suppressing section according to the present embodiment is constituted by causing the controller 58 to control predetermined component devices on the basis of appropriate information of the sensors according to information representing control operations that will be described later. Consequently, reduction in transporting-speed of an uppermost recording sheet P1 from a predetermined transporting speed can effectively be suppressed. Hereinafter, practical control operations are described as those of examples.

EMBODIMENT 1

Figure 3:
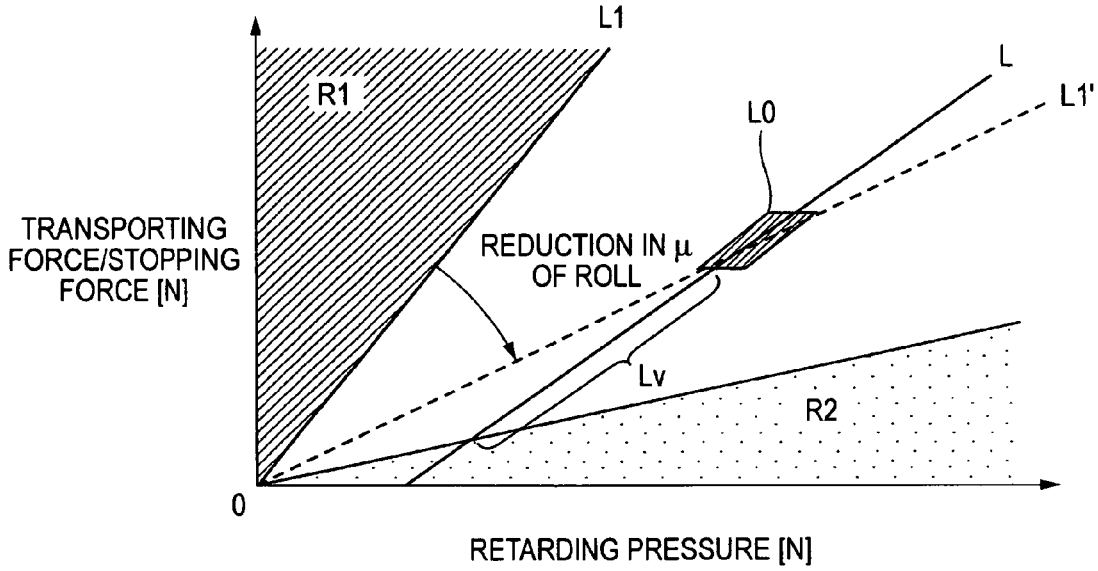
FIG. 3 is a schematic view illustrating a relation between the friction coefficient and the transporting performance of a roll.

According to the present inventor's study, it has been found that generally, a primary cause of occurrence of a slippage is reduction in friction coefficient of the transporting roll due to abrasion thereof. FIG. 3 illustrates the relation between reduction in the friction coefficient of the roll and the transporting performance thereof.

In FIG. 3, a straight line L represents an operating line of the separation section including the transporting roll 53 and the separation roll 55. The separation section generates a predetermined forward-direction transporting force and an opposite-direction separation torque at an operating point $L_0$ on the straight line L. This operating point $L_0$ moves on the predetermined operating line L according to the separation torque of the separation roll 55.

A region R1 extending above the operating line L is an area (i.e., a misfeed area) in which a transport failure occurs due to insufficient transporting force. On the other hand, another region R2 extending below the operating line L is an area (i.e., a multiple-feed area) in which a multiple-feed occurs due to reduction in separation performance.

According to the present inventor's study, it is found that the reduction in friction coefficient of the transporting roll 53 expands the range of the misfeed area R1 and has substantially no effects on the operating line L and the multiple-feed area R2. More specifically, it is found that the gradient of a straight line L1 representing a border of the misfeed area R1 decreases with reduction of the friction coefficient, and is changed to a straight line indicated by a dashed line L1 shown in FIG. 3, that consequently, the misfeed area R1 is expanded, and that however, the straight line L and the region R2 do not vary.

Accordingly, it is found out that it is effective to downwardly move the operating point $L_0$ of the separation section along the predetermined operating line L so as to avoid the misfeed area R1, which expands with reduction in the friction coefficient, to thereby prevent occurrence of a transport failure and a multiple-feed. More specifically, the separation torque of the separation roll 55 is set so that the operating point L0 is on a part of the straight line L, which is above a line segment $L_v$. Consequently, reduction in the transporting performance can be suppressed without degrading the separation performance.

Figure 4A:
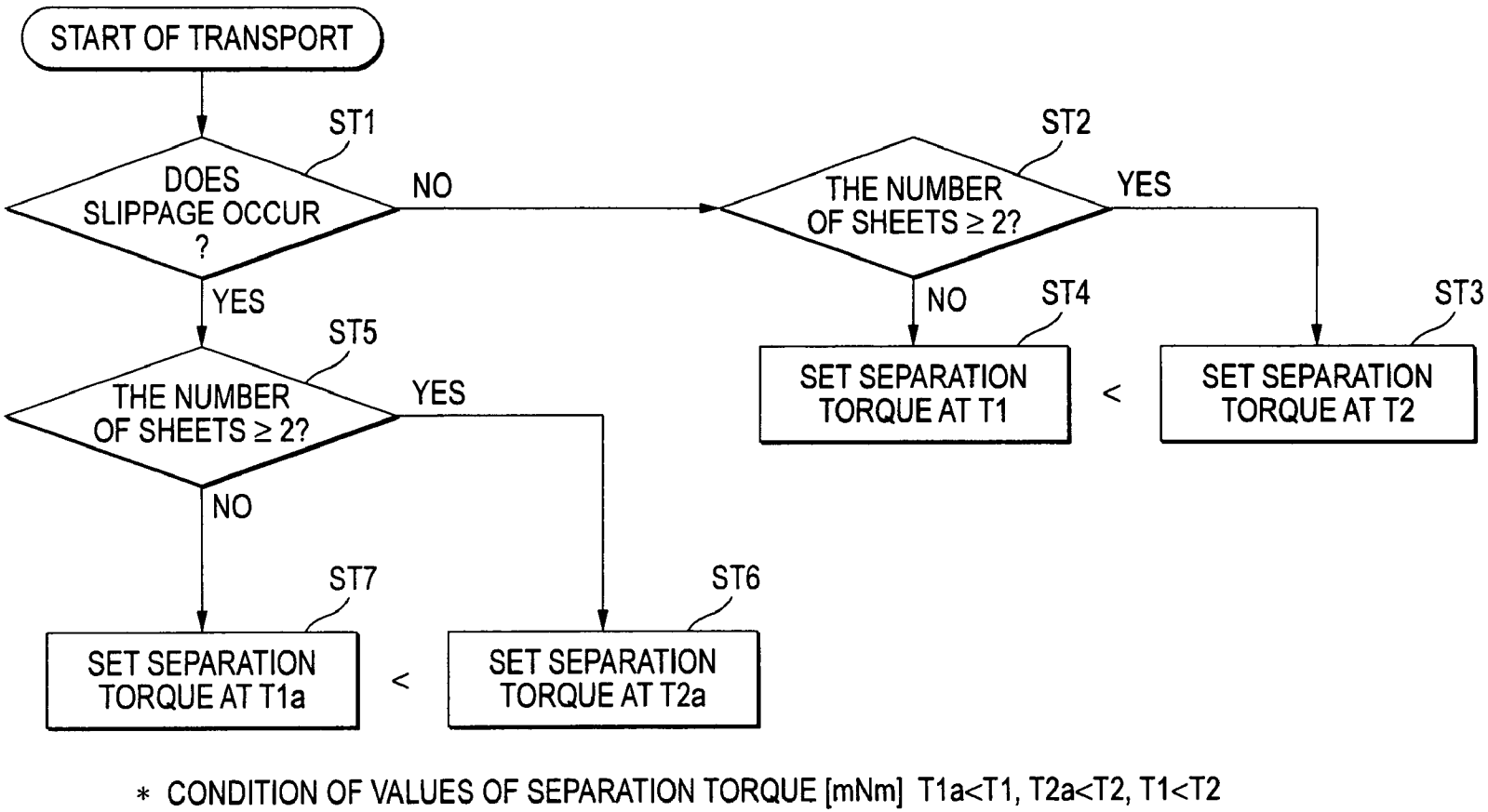
FIG. 4A is a flowchart illustrating a control procedure according to Embodiment 1.

Thus, according to the present embodiment, in a case where the slippage detecting section detects a slippage, the separation torque to be generated in the separation roll 55 is changed according to the number of recording sheets P that are present in the press-contact portion 50N. A practical control operation according to the present embodiment is described below with reference to FIGS. 4A and 4B. FIG. 4A is a flowchart illustrating a control procedure according to the present embodiment. FIG. 4B is a table summarizingly describing the relation between the number of recording sheets and the value of separation torque in a separation portion according to the present embodiment.

As illustrated in FIG. 4A, first, in step ST1, the slippage detecting section detects the presence/absence of occurrence of a slippage according to a transport start instruction. More specifically, for example, a rotation speed V0 of the detection roll 51 corresponding to the transporting speed of a recording sheet P is compared with a predetermined rotation speed Vf of the transporting roll 53 or with a predetermined rotation speed Vt of the drawing roll 50T. In a case where Vf (or Vt)≈V0, the slippage detecting section determines that no slippage occurs. In a case where Vf (or Vt)>V0, the slippage detecting section determines that a slippage occurs between the recording sheet P and the roll corresponding to a slippage to be detected. A reference value V0 can be set to be a predetermined constant value, or to have a predetermined range including a fluctuation band. When the slippage detecting section determines whether a slippage occurs, the slippage detecting section can determine the presence/absence of occurrence of a slippage by comparing, for example, an amount of rotation of the detection roll 51 corresponding to an amount of movement of a recording sheet P with an amount of rotation of the transporting roll 53 or with an amount of rotation of the drawing roll 50T, instead of comparing the rotation speed there between.

Next, in a case where it is determined that no slippage occurs, the sheet number detecting sensor 52 determines in step ST2 the presence/absence of a multiple-feed (i.e., whether two or more recording sheets P are present in the press-contact portion 50N formed by the transporting roll 53 and the separation roll 55).

Then, in a case where a multiple-feed occurs (i.e., two or more recording sheets P are present in the press-contact portion 50N), the separation torque of the separation roll 55 is set at a predetermined value T2 in step ST3. In a case where no multiple-feed occurs, the separation torque of the separation roll 55 is set at a predetermined value T1 in step ST4. Incidentally, T1<T2. A reason for generating the separation torque T1 even in the case of occurrence of no multiple-feed is that the sheet feeding apparatus is enabled to immediately deal with a subsequent possible multiple-feed. However, the apparatus can be controlled so that the separation torque T1 is not generated (i.e., the separation torque is set to be 0).

On the other hand, in a case where it is determined that a slippage occurs, continuously and similarly, the slippage detecting section determines the presence/absence of occurrence of a multiple-feed in step ST5.

Then, in a case where a multiple-feed occurs, the separation torque of the separation roll 55 is set at a predetermined value T2*a* (T2*a*<T2) in step ST6. In a case where no multiple-feed occurs, the separation torque of the separation roll 55 is set at a predetermined value T1*a* (T1*a*<T1) in step ST7. Incidentally, T1*a*<T2*a*. FIG. 4B illustrates a table that summarizingly describes the relation between the number of recording sheets P, which are present in the press-contact portion 50N, and the value of the separation torque generated at the separation roll 55.

Thus, according to the multiple-feed state and to the presence/absence of occurrence of a slippage, the values T1, T1*a*, T2, and T2*a* of the separation torque generated at the separation roll 55 are set on the line segments $L_v$ shown in FIG. 3 so as to meet the predetermined relations: T1*a*<T1, T2*a*<T2, and T1<T2. Consequently, reduction in transporting performance due to a slippage can be suppressed without degrading the separation performance.

The multiple-feed detecting sensor according to the present embodiment does not always need to determine the number of recording sheets that are present in the press-contact portion 50N. It is sufficient to determine whether the number of recording sheets being present in the press-contact portion 50N is 1 or more. Consequently, simpler sensors can be used.

EMBODIMENT 2

Figure 5A:
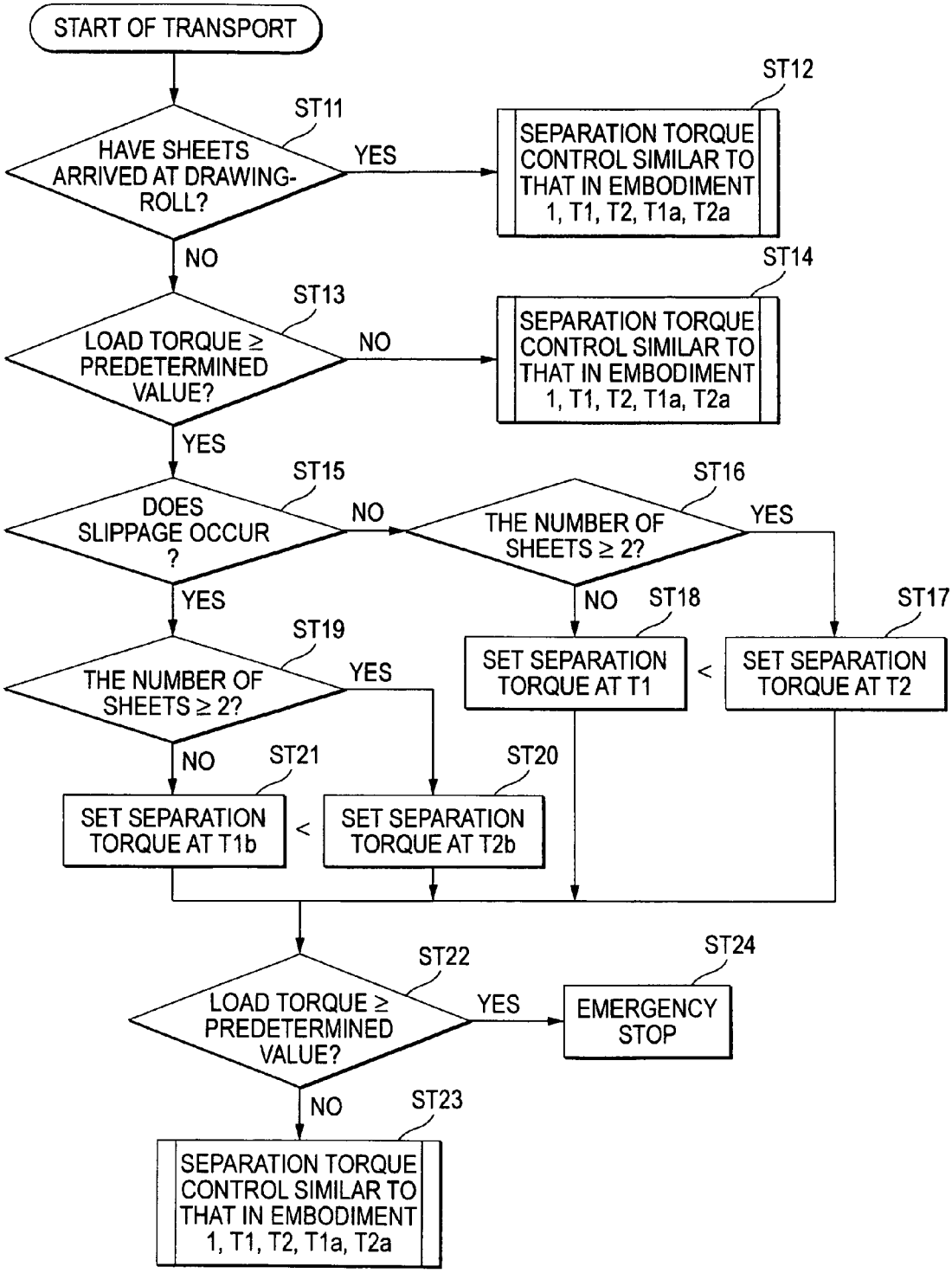
FIG. 5A is a flowchart illustrating a control procedure according to Embodiment 2.

The present embodiment is configured to change the separation torque of the separation roll 55 according to the load torque of the transporting roll 53, in addition to the control operations performed in Embodiment 1, so as to achieve appropriate separation/transport even in a case where a forward direction transport failure occurs on a transporting path between the press-contact portion 50N of the separation section and the drawing roll 50T. Practical control operations are described below with reference to FIGS. 5A and 5B. FIG. 5A is a flowchart illustrating a control procedure. FIG. 5B is a table summarizingly describing the relation between the number of recording sheets and the value of separation torque. Incidentally, examples of the forward direction transport failure are an increase in electrostatic transporting resistance due to an electrostatic-adsorption force acting between recording sheets, and an increase in physical transporting resistance, such as connection, on the transporting path.

As illustrated in FIG. 5A, first, in step ST11, according to a transport start instruction, the arrival detecting section detects whether a recording sheet P has arrived the drawing roll 50T.

In a case where a leading end of the recording sheet P has arrived at the drawing roll 50T, the arrival detecting section determines that there is no increase in the transporting resistance which becomes an impediment. Then, the apparatus performs an operation of controlling separation torque, similarly to the aforementioned Embodiment 1. More specifically, as illustrated in FIG. 5*b*, the separation torque is set at one of the values T1, T2, T1*a*, and T2*a* at step ST12 according to the presence/absence of occurrence of a slippage and to that of occurrence of a multiple-feed.

In a case where a leading end of a recording sheet P has not arrived at the drawing roll 50T, next, the torque sensor provided at the transporting roll 53 detects load torque TL and determines in step ST13 whether the value of the load torque TL is equal to or more than a predetermined value TL0.

In a case where the value of the detected load torque TL is less than the predetermined value TL0, a separation torque control operation similar to that performed in step ST12 is performed in step ST14.

Conversely, in a case where the value of the detected load torque TL is equal to or more than the predetermined value TL0, it is determined that there is an increase in the transporting resistance, which is an impediment, on the transporting path between the separation portion and the drawing portion. Then, the separation torque of the separation roll 55 is increased. Consequently, a retarding pressure (i.e., a press-contact pressure exerted on the transporting roll 53 from the separation roll 55) is increased. Thus, a frictional force, which acts between the transporting roll 53 and the recording sheet P, is increased. Consequently, a forward-direction transporting force exerted on the recording sheet P is increased. That is, the transporting force is increased, as competition with the increase in the transporting resistance.

More specifically, in the aforementioned state, the presence/absence of a slippage is detected in step ST15. In a case where a slippage occurs, further, the presence/absence of a multiple-feed (i.e., whether plural recording sheets are present in the press-contact portion 50N) is detected in step ST16. In a case where a multiple-feed occurs, the separation torque to be generated at the separation roll 55 is set at the value T2 in step ST17. In a case where no multiple-feed occurs, the separation torque is set at the value T1 in step ST18.

On the other hand, in a case where the occurrence of a slippage is detected in step ST15, further, the presence/absence of occurrence of a multiple-feed is detected in step ST19. In a case where a multiple-feed occurs, the separation torque to be generated at the separation roll 55 is increased and is set at a value T2*b* (incidentally, T2*b*>T2) in step ST20. Similarly, even in a case where no multiple-feed occurs, the separation torque is increased and is set at a value T1*b* (T1*b*>T1) in step ST21. Thus, the forward-direction transporting force exerted on the recording sheet P by the transporting roll 53 can be increased, as competition with the increase in the transporting resistance, by increasing the values of the separation torque to those T1*b* and T2*b* in the case where the load torque, whose value is equal to or more than the predetermined value TL0 of the load torque is detected. Consequently, the possibility of eliminating the impediment to the forward-direction transport can be enhanced.

Subsequently, it is determined again in step ST22 whether the value of the load torque TL is equal to or more than a predetermined value TL0. In a case where the value of the load torque TL is less than the predetermined value TL0, it is determined that the impediment to the forward-direction transport is eliminated, a separation torque control operation similar to that performed in Embodiment 1 is performed in step ST23. In a case where the value of the load torque TL is equal to or more than the predetermined value TL0, it is determined that the impediment, which cannot be eliminated by such a separation torque control operation, to the forward-direction transport is caused. Then, for example, an emergency stop of the apparatus is performed in step ST24. Incidentally, in a case where it is determined in step ST22 that the value of the load torque TL is equal to or more than the predetermined value TL0, a cycle of steps ST15 to ST22 can be repeated a predetermined number of times so as to enhance the possibility of eliminating the impediment to the forward-direction transport still more.

Even in the present embodiment, it is sufficient for the multiple-feed detecting sensor to determine whether the number of recording sheets being present in the press-contact portion 50N is one or more. Thus, a simpler sensor can be used. Further, when the slippage detecting section detects the presence/absence of occurrence of a slippage, it is preferable from the viewpoint of more effectively suppressing reduction in the transporting speed due to the slippage to detect the presence/absence of occurrence of a slippage with respect to the drawing rolls 50T in a case where a recording sheet P has arrived at the drawing rolls 50T. In a case where a recording sheet P has not arrived at the drawing rolls 50T, it is preferable to detect the presence/absence of occurrence of a slippage with respect to the transporting rolls 53.

Thus, according to the separation control operation in the present embodiment, the determination of the status of the load torque at the transporting roll 53 is added to the control operation performed in the aforementioned Embodiment 1. Consequently, even transport abnormality occurring between the separation roll 55 and the drawing roll 50T can appropriately be controlled according to the cause thereof. Accordingly, reduction in the transporting speed of a recording sheet can be suppressed more effectively and stably.

EMBODIMENT 3

Generally, in a case where the number of recording sheets being present in the press-contact portion 50N is large (i.e., equal to or more than 3), an apparatus failure, such as a jam, is liable to occur. Thus, it is preferable to increase the separation torque so that the multiply-fed sheets P2, P3 . . . other than the uppermost recording sheet P1 is immediately and reversely fed.

On the other hand, in a case where the multiply-fed recording sheets is 2, the separation torque provided to the separation roll 55 is liable to cause reciprocating motions of a second sheet P2, which is separated by the separation section from the uppermost recording sheet, to repeat motions of going into and out of the press-contact portion 50N. According to the present inventor's study, it has been found that the reciprocating motions around the press-contact portion 50N are propagated to the separation roll 55 and the transporting roll 53 as transient oscillations and result in reduction in separation performance of the separation section.

Figure 6A:
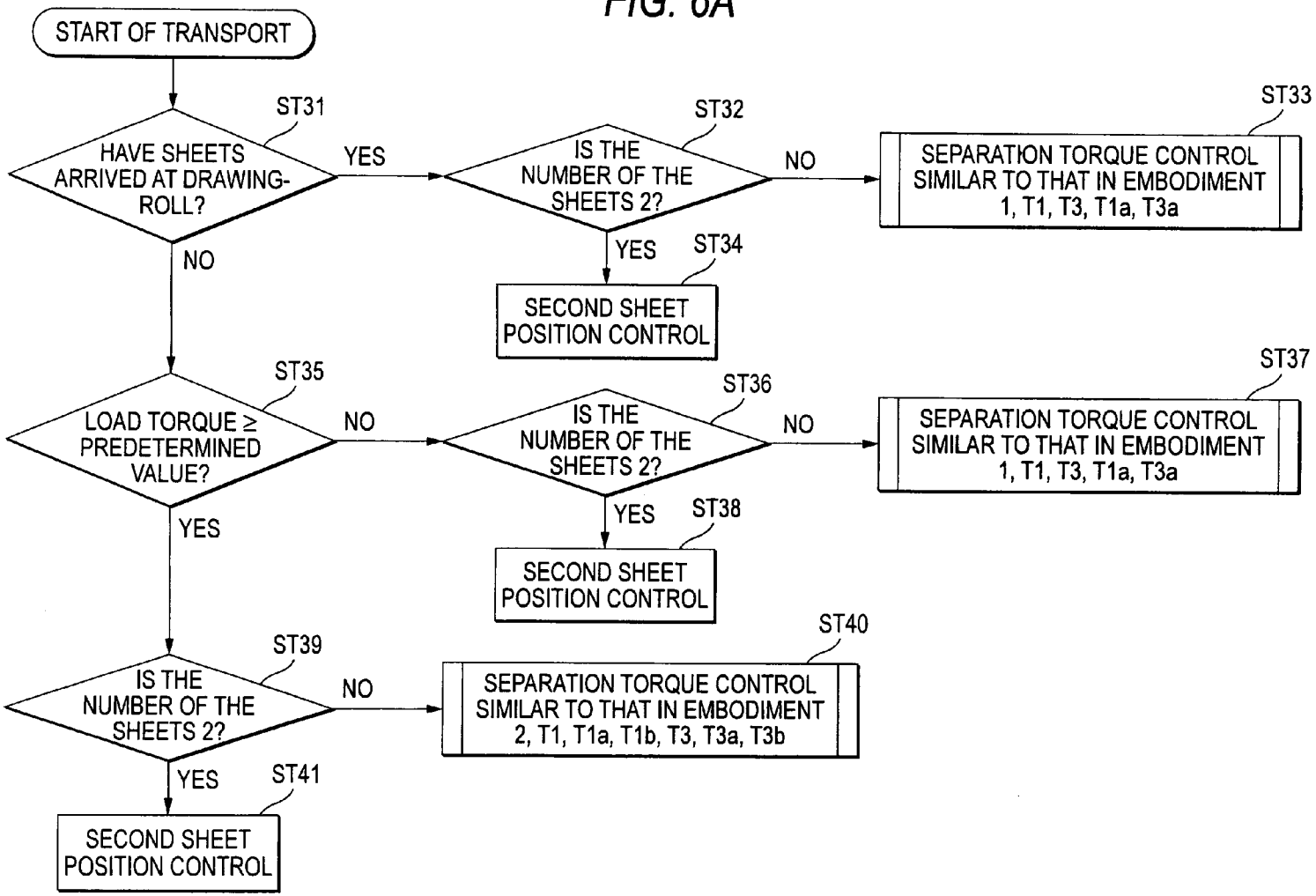
FIG. 6A is a flowchart illustrating a control procedure according to Embodiment 3.

Thus, according to the present embodiment, the control operations according to the aforementioned Embodiment 2 are improved so that the number of recording sheets P, which are present in the press-contact portion 50N, and that when the number of multiply-fed recording sheets is 2, a second sheet position control operation of stopping a second recording sheet at a predetermined position is performed. Practical control operations according to the present embodiment are described below with reference to FIGS. 6A and 6B. FIG. 6A is a flowchart illustrating a control procedure according to the present embodiment. FIG. 6B is a table summarizingly describing the relation between the number of recording sheets and the value of separation torque according to the present embodiment.

As illustrated in FIG. 6A, first, in step ST31, according to a transport start instruction, the arrival detecting section detects whether a recording sheet P has arrived the drawing roll 50T.

In a case where a leading end of the recording sheet P has arrived at the drawing roll 50T, the sheet number detecting sensor 52 determines the number of recording sheets P, which are present in the press-contact portion 50N, in step ST32. In a case where the detected number of recording sheets is other than 2 (i.e., the detected number of sheets 0, 1, or 3 or more), the apparatus performs an operation of controlling separation torque, similarly to the aforementioned Embodiment 1 in step ST33. In a case where a multiple-feed occurs at that time (i.e., in a case where the detected number of recording sheets is 3 or more), the value of the separation torque generated at the separation roll 55 may be T2 or T2*a*, similarly to the aforementioned Embodiment 1. However, preferably, the value of the separation torque generated at the separation roll 55 is a larger value T3 or T3*a* (incidentally, T3>T2, T3*a*>T2*a*).

On the other hand, in a case where the detected number of recording sheets is 2, the following second sheet position control operation is performed. That is, in a case where it is detected that the number of multiply-fed recording sheets is 2, an amount of displacement of a second recording sheet, which is performed since a detection point of time, is calculated according to the rotation speed of the separation roll 55. A sequentially variable control operation of the separation torque to be generated at the separation roll 55 is performed in step ST 34 so that the leading end of the second recording sheet P2 is stopped at a predetermined position between the press-contact portion 50N and the drawing roll 50T.

Next, in a case where the leading end of the recording sheet P has not arrived at the drawing roll 50T, the torque sensor 54 provided at the transporting roll 53 detects the load torque TL and determines in step ST35 whether the value of the load torque TL is equal to or more than a predetermined TL0.

In a case where the value of the detected load torque TL is less than the predetermined value TL0, operations of setting the separation torque (at T1, T3, T1*a*, or T3*a*) or second sheet position control operations are performed in steps ST36 to ST38 according to the number of recording sheets, which are present in the press-contact portion 50N, similarly to processing performed in steps ST32 to ST34.

Conversely, in a case where the value of the detected load torque is equal to or more than the predetermined value TL0, it is determined in step ST39 whether the number of recording sheets P being present in the press-contact portion is 2. In a case where the number of recording sheets P is other than 2 (i.e., 0, 1, or 3 or more), the separation torque is set (at T1, T1*a*, T1*b*, T3, T3*a*, or T3*b*) according to the presence/absence of occurrence of a slippage, and to the presence/absence of occurrence of a multiple-feed, similarly to Embodiment 2. At that time, in a case where a multiple-feed occurs (i.e., in a case where the number of recording sheets being present in the press-contact portion is 3 in the case of the present embodiment), the value of the separation torque to be generated at the separation roll 55 may be T2, T2*a*, or T2*b*, similarly to the aforementioned Embodiment 2. However, preferably, the value of the separation torque to be generated at the separation roll 55 is a larger value T3, T3*a*, or T3*b* (incidentally, T3>T2, T3*a*>T2*a*, and T3*b*>T2*b*). On the other hand, in a case where the number of recording sheets P being present in the press-contact portion is 2, the aforementioned second sheet position control operation is performed in step ST41.

Thus, according to the present embodiment, the second sheet position control operation of performing the sequentially variable control of the separation torque, which is to be generated at the separation roll 55, so that the leading end of the second recording sheet P2 is stopped at the predetermined position between the press-contact portion 50N and the drawing roll 50T. Consequently, oscillations due to reciprocating motions, which are likely to occur in a case where the number of multiply-fed recording sheets is 2, can be prevented from occurring. Accordingly, reduction in the separation performance and the transporting performance can be prevented.

EMBODIMENT 4

Generally, a drawing failure occurs in a case where the friction coefficient of the drawing rolls 50T is reduced, so that the forward-direction transporting force is less than the separation torque generated at the separation roll 55.

Figure 7:
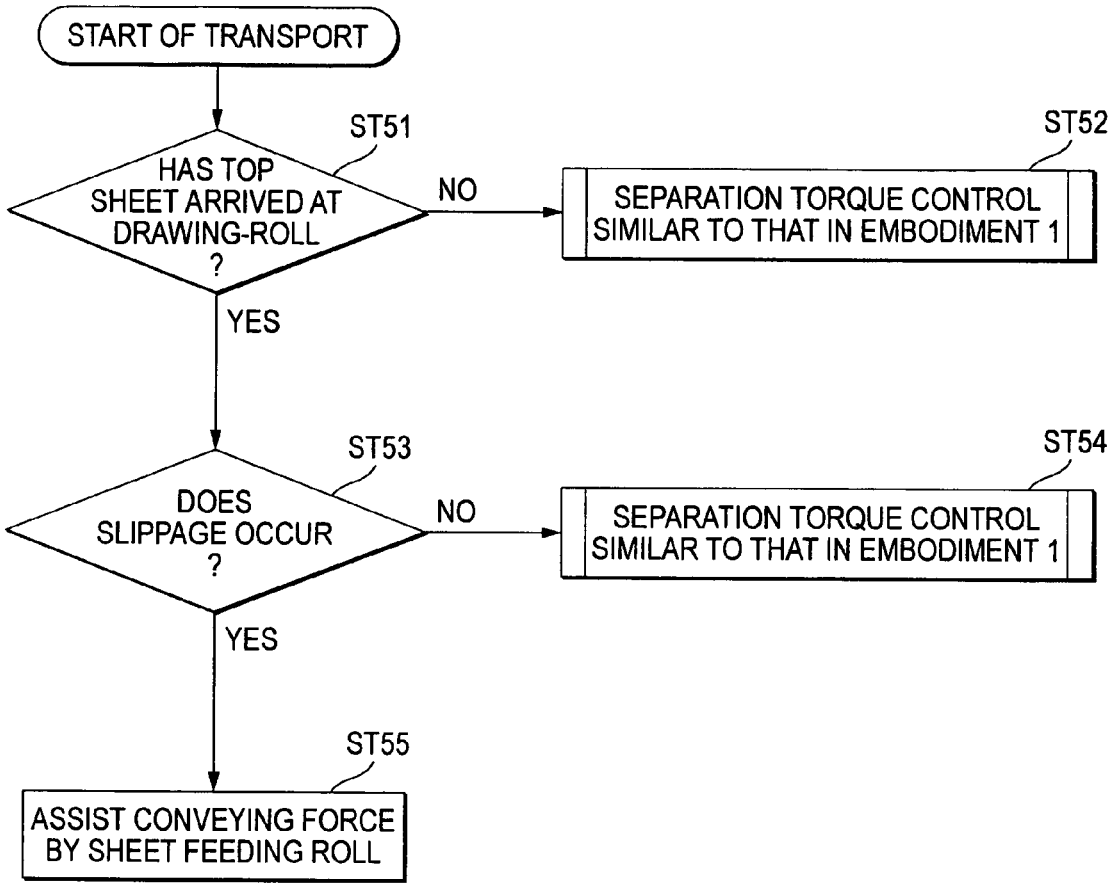
FIG. 7 is a flowchart illustrating a control procedure according to Embodiment 4, wherein reference numerals and signs are set forth below.

Thus, according to the present embodiment, in a case where the uppermost recording sheet P1 arrives at the drawing roll 50T, and where a slippage occurs between this recording sheet P1 and the drawing roll 50T, the transporting force is assisted by the sheet feeding roll 50P. A practical control operation according to the present embodiment is described below with reference to FIG. 7. Incidentally, it is assumed that in the present embodiment, the sheet feeding roll 50P is in contact with the uppermost recording sheet P1 until the leading end portion of a recording sheet P arrives at the drawing roll 50T and that subsequently, the sheet feeding roll 50P is separated from the recording sheet P.

First, in step ST51, it is detected whether the uppermost sheet P1 of recording paper arrives at the drawing roll 50T.

In a case where the recording sheet P1 does not arrive at the drawing roll 50T, a separation torque control operation similar to that performed in the aforementioned Embodiment 1 is performed in step ST52.

On the other hand, in a case where the sheet P1 of recording paper has arrived at the drawing roll 50T, a predetermined amount of rotation of the drawing roll 50T is compared with a detected amount of rotation detected using the detection roll 51. Thus, it is determined in step ST53 whether a slippage occurs between the recording sheet P1 and the drawing roll 50T.

In a case where no slippage occurs, a separation torque control operation similar to that performed in Embodiment 1 is conducted in step ST54, similar to step ST52.

On the other hand, in a case where a slippage occurs, a press-contact force exerted by the sheet feeding roll SOP on the recording sheet P1 is increased. Consequently, in step ST55, the transporting force exerted on the uppermost recording sheet P1 is assisted by being increased. Accordingly, reduction in the transporting speed is suppressed.

A first modification of the present embodiment is configured so that at a moment, at which the recording sheet P1 arrives at the press-contact portion 50N, the press-contact force to be exerted on the recording sheet P1 by the sheet feeding roll 50P is reduced to a minimum level sufficient to the extent that the sheet feeding roll 50P is separated from the recording sheet P1. In a case where the slippage is detected at the moment at which the recording sheet P1 arrives at the drawing roll 50T, the transporting force is assisted by changing and increasing the press-contact force exerted by the sheet feeding roll 50P to a predetermined value (incidentally, this predetermined value is substantially equal to a value of the strength of the press-contact force at the start of the sheet-feeding or is a certain predetermined value). Consequently, according to the first modification, reduction in the transporting speed can be suppressed.

Although the present embodiment is configured so that the sheet feeding roll SOP is in contact with the recording sheet P1 until the recording sheet P1 arrives at the drawing roll 50T, this example can be configured so that the sheet feeding roll 50P is separated from the recording sheet P1, for example, at a time, at which the recording sheet P1 arrives at the press-contact portion 50N, so as to reduce a transporting load.

A modification in this case (i.e., a second modification) can be configured to assist the forward-direction transporting force by press-contacting the sheet feeding roll 50P with the uppermost recording sheet P1 in a case where a slippage occurs at the time, at which the recording sheet P1 arrives at the drawing roll 50T.

Each of the aforementioned examples can singly be implemented. Apparently, appropriate combinations of the aforementioned examples can be implemented. For example, in a case where a slippage is detected when the recording sheet P1 arrives at the drawing roll 50T, the separation torque of the separation roll 55 can be reduced, in addition to the assisting the transporting force with the sheet feeding roll 50P.

What is claimed is:

1. A sheet feeding apparatus comprising:

a controller;

a multiple-feed detecting section that detects recording sheets superposed with each other to be transported by a plurality of rolls in a direction;

a separating section that, in a case where recording sheets superposed with each other are transported, separates an uppermost sheet of the recording sheets from an other sheet;

a slippage detecting section that detects a slippage of the uppermost recording sheet with respect to a roll;

a transporting-speed reduction suppressing section that suppresses a transporting-speed of the uppermost recording sheet from reducing from a value, the separation section including: a transporting roll that transports recording sheets in a transporting direction; and a separation roll that is placed to be opposed to and to be press-contacted with the transporting roll through a recording sheet, a drawing roll disposed downstream from a press-contact portion between the transporting roll and the separation roll, the drawing roll drawing a recording sheet out of the press-contact portion and transporting the drawn recording sheet in the transporting direction;

an arrival detecting section that detects whether the uppermost recording sheet arrives at the drawing roll; and a load torque detecting section that detects a load torque of the transporting roll;

the transporting-speed reduction suppressing section changing a separation torque of the separation roll based on a result of detection by the arrival detecting section, a result of detection by the multiple-feed detecting section and a result of detection by the slippage detecting section, the transporting-speed reduction suppressing section being controlled by the controller, wherein in a case where a slippage is detected by the slippage detecting section before the arrival detecting section detects that the uppermost recording sheet arrives at the drawing roll and where the load torque of the transporting roll is equal to or more than a torque value, the transporting-speed reduction suppressing section increases the separation torque, and in a case where a slippage is detected by the slippage detecting section before the arrival detecting section detects that the uppermost recording sheet arrives at the drawing roll and where the load torque of the transporting roll is less than the torque value, the transporting-speed reduction suppressing section decreases the separation torque.

2. The sheet feeding apparatus according to claim 1, wherein the transporting-speed reduction suppressing section reduces the separation torque in a case where a slippage is detected by the slippage detecting section after the arrival detecting section detects that the uppermost recording sheet arrives at the drawing roll.

3. The sheet feeding apparatus according to claim 1, wherein in a case where the uppermost recording sheet does not arrive at the drawing roll, the slippage detecting section detects a difference between a transporting speed or a displacement amount of the uppermost recording sheet and a corresponding rotation speed or a corresponding rotation amount of the transporting roll, and wherein in a case where the uppermost recording sheet arrives at the drawing roll, the slippage detecting section detects a difference between a transporting speed or a displacement amount of the uppermost recording sheet and a corresponding rotation speed or a corresponding rotation amount of the drawing roll.

4. The sheet feeding apparatus according to claim 1, wherein the arrival detecting section is adapted to detect a rotation amount of a roll press-contacted with the uppermost recording sheet, and the roll is adapted to detect a speed or a displacement amount of the uppermost recording sheet in the slippage detecting section.

5. The sheet feeding apparatus according to claim 1, wherein the multiple-feed detecting section detects the number of recording sheets transported to the press-contact portion between the transporting roll and the separation roll, and in a case where there are two recording sheets detected by the multiple-feed detecting section, the transporting-speed reduction suppressing section changes the separation torque of the separation roll so that a leading end of a second recording sheet is stopped at a position between the press-contact portion and the drawing roll.

6. The sheet feeding apparatus according to claim 1, further comprising a sheet feeding roll contactably with accommodated recording sheets to supply an uppermost recording sheet onto a transporting path, in a case where the slippage detecting section detects a slippage of the uppermost recording sheet with respect to the drawing roll, the transporting-speed reduction suppressing section assists the sheet feeding roll in transporting the uppermost recording sheet in the transporting direction.

7. An image forming apparatus comprising:

a sheet feeding apparatus according to claim 1; and an image forming section that forms an image on a recording sheet.

8. A method for feeding a sheet, comprising:

detecting recording sheets superposed with each other to be transported by a plurality of rolls in a direction;

in a case where recording sheets superposed with each other are transported, separating an uppermost sheet of the recording sheets from an other sheet;

detecting a slippage of the uppermost recording sheet with respect to a roll;

suppressing a transporting-speed of the uppermost recording sheet from reducing from a value, the separating being performed by a section including: a transporting roll that transports recording sheets in transporting direction; and a separation roll that is placed to be opposed to and to be press-contacted with the transporting roll through a recording sheet, drawing a recording sheet out of a press-contact portion and transporting the drawn recording sheet in the transporting direction by a drawing roll disposed downstream from the press-contact portion between the transporting roll and the separation roll;

detecting whether the uppermost recording sheet arrives at the drawing roll by an arrival detecting section; and detecting a load torque of the transporting roll by a load torque detecting section;

the suppressing being performed by changing a separation torque of the separation roll based on a result of detection by the arrival detecting section, a result of detection of the recording sheets transported superposed with each other and a result of detection of the slippage of the uppermost recording sheet, the suppressing being controlled by a controller, wherein in a case where a slippage is detected before detecting that the uppermost recording sheet arrives at the drawing roll and where the load torque of the transporting roll is equal to or more than a torque value, the transporting-speed reduction suppressing section increases the separation torque, and in a case where a slippage is detected before detecting that the uppermost recording sheet arrives at the drawing roll and where the load torque of the transporting roll is less than the torque value, the transporting-speed reduction suppressing section decreases the separation torque.

9. The sheet feeding apparatus according to claim 1, wherein in a case where a slippage is not detected by the slippage detecting section before the arrival detecting section, the transporting-speed reduction suppressing section does not change the separation torque based on a result of the detection by the slippage detecting section.

10. The method according to claim 8, wherein in a case where a slippage is not detected by the slippage detecting section before the arrival detecting section, the transporting-speed reduction suppressing section does not change the separation torque based on a result of the detection by the slippage detecting section.

* * * * *